US010822767B2

(12) United States Patent
Huber et al.

(10) Patent No.: US 10,822,767 B2
(45) Date of Patent: Nov. 3, 2020

(54) TRENCH WALL APPARATUS AND METHOD FOR CREATING A TRENCH IN THE GROUND

(71) Applicants: BAUER Maschinen GmbH, Schrobenhausen (DE); VSL International LTD, Bern (CH)

(72) Inventors: Ludwig Andreas Huber, Talhausen (DE); Leonhard Weixler, Thierhaupten (DE); Olivier Pierre Dominique Haye, Bagneux (FR); Philippe Manuel De Sousa, Paray Vielle Poste (FR)

(73) Assignees: BAUER Maschinen GmbH, Schrobenhausen (DE); VSL International LTD, Bern (CH)

( * ) Notice: Subject to any disclaimer, the term of this patent is extended or adjusted under 35 U.S.C. 154(b) by 211 days.

(21) Appl. No.: 15/970,615

(22) Filed: May 3, 2018

(65) Prior Publication Data

US 2018/0327996 A1 Nov. 15, 2018

(30) Foreign Application Priority Data

May 11, 2017 (EP) ..... 17170545

(51) Int. Cl.
*E02D 17/13* (2006.01)
*E02F 3/22* (2006.01)
(Continued)

(52) U.S. Cl.
CPC ..... *E02F 3/183* (2013.01); *E02D 17/13* (2013.01); *E02F 3/205* (2013.01); *E02F 3/22* (2013.01); *E21B 4/18* (2013.01)

(58) Field of Classification Search
CPC .. E21B 4/18; E02F 3/183; E02F 3/205; E02F 3/22; E02D 17/13
See application file for complete search history.

(56) References Cited

U.S. PATENT DOCUMENTS 3,357,506 A * 12/1967 De Bosredon ..... E02F 3/47 175/99
6,446,364 B1 * 9/2002 Herrero Codina ..... E02F 3/22 37/187

(Continued)

FOREIGN PATENT DOCUMENTS

DE 1534611 A1 * 8/1969 ..... E21C 35/08
DE 23 34 591 A1 1/1975

(Continued)

OTHER PUBLICATIONS

An Office Action mailed by the Korean Intellectual Property Office dated Jan. 8, 2019, which corresponds to Korean Patent Application No. 10-2018-0054057 and is related to U.S. Appl. No. 15/970,615.

(Continued)

*Primary Examiner* — Frederick L Lagman
*Assistant Examiner* — Stacy N Lawson
(74) *Attorney, Agent, or Firm* — Studebaker & Brackett PC

(57) ABSTRACT

A trench wall apparatus includes a base frame held at its top end by a holding means held by at least one soil excavation means, which is positioned at a bottom end of the base frame. When soil is excavated while forming the trench, the trench wall apparatus is held by a clamping means that includes at least two clamping elements on opposite sides extended laterally by at least one actuating cylinder, whereby at least one part of the trench wall apparatus is clamped in the trench, and a pressing means applies a pressing force on the at least one soil excavation means. The clamping elements and clamping cylinder are positioned on an intermediate frame displaceably mounted along the base frame. The intermediate frame is clamped and fixed to the ground by the clamping means. The base frame having the (Continued)

soil excavation means is pressed downward by the pressing means.

10 Claims, 7 Drawing Sheets

(51) Int. Cl.

| | |
|---|---|
| ***E02F 5/02*** | (2006.01) |
| ***E02F 3/18*** | (2006.01) |
| ***E02F 3/20*** | (2006.01) |
| *E21B 4/18* | (2006.01) |

(56) References Cited

U.S. PATENT DOCUMENTS

| | | | | |
|---|---|---|---|---|
| 2003/0037464 | A1* | 2/2003 | Gessay | E02D 17/13 37/189 |
| 2003/0074810 | A1* | 4/2003 | Gessay | E02D 17/13 37/347 |
| 2011/0253450 | A1* | 10/2011 | Arzberger | E02D 17/13 175/57 |
| 2019/0040601 | A1* | 2/2019 | Cascarino | E02D 17/13 |
| 2019/0048552 | A1* | 2/2019 | Cascarino | E02F 3/205 |
| 2019/0085524 | A1* | 3/2019 | Cascarino | E02D 17/13 |

FOREIGN PATENT DOCUMENTS

| | | | | |
|---|---|---|---|---|
| DE | 697 28 713 | T2 | 3/2005 | |
| EP | 0412477 | A1 * | 2/1991 | E02F 3/413 |
| EP | 0811724 | A1 | 12/1997 | |
| EP | 0 811 724 | B1 | 4/2004 | |
| EP | 2 378 002 | A1 | 10/2011 | |
| JP | 2006-257869 | A | 9/2006 | |
| KR | 10-2014-0029276 | A | 3/2014 | |
| WO | WO-2017042499 | A2 * | 3/2017 | E21B 10/62 |

OTHER PUBLICATIONS

An Office Action issued by the Canadian Intellectual Property Office dated Feb. 18, 2019, which corresponds to Canadian Patent Application No. 3,004,009 and is related to U.S. Appl. No. 15/970,615.

European Search Report issued by the European Patent Office dated Nov. 24, 2017, which corresponds to European Patent Application No. 17 17 0545.

Examination Report issued by the GCC Patent Office dated Feb. 17, 2020, which corresponds to GCC Patent Application No. GC 2018-35277 and is related to U.S. Appl. No. 15/970,615.

* cited by examiner

TRENCH WALL APPARATUS AND METHOD FOR CREATING A TRENCH IN THE GROUND

BACKROUND

Technical Field

The invention relates to a trench wall apparatus for creating a trench in the ground, having a base frame, at least one soil excavation means at a bottom end section of the base frame, a holding means at a top end section of the base frame, a clamping means with at least two laterally movable clamping elements positioned opposite and at least one actuating cylinder, which causes the clamping elements to extend laterally in order to clamp at least one part of the slurry wall apparatus in the trench, and a pressing means that allows a pressing force to be applied to at least one soil excavation means.

The invention also relates to a method for creating a trench in the ground using a trench wall apparatus, whereby a base frame of the trench wall apparatus is held at its top end section by means of a holding means by means of at least one soil excavation means, which is positioned at a bottom end area of the base frame, soil is excavated while forming the trench, by means of a clamping means at least two clamping elements positioned opposite are extended laterally by at least one actuating cylinder, whereby at least one part of the trench wall apparatus is clamped in the trench, and by means of a pressing means is applied a pressing force onto the at least one soil excavation means

Background Art

Trench wall apparatuses of this kind are particularly known as so-called trench cutters having cutting wheels as soil excavation means. These are usually hung on a supporting apparatus via a carrying rope. The weight of the trench wall apparatus thus limits the maximum pressing force to the ground at such apparatuses.

However, when working with harder soils, for example those containing stones or rocks, it may be necessary to apply a greater pressing force on the cutting wheels. In principle, this can be done from outside the trench using lifting platforms or equivalent hydraulic cylinders on the supporting apparatus. In this case, however, a suitably heavy rod is required to transfer the axial forces to the slurry wall apparatus, which is very expensive overall.

Prior art of this generic kind can be found in EP 0 811 724 B1 and DE 697 28 713 T2. These well-known trench cutters have lateral clamping elements on a base frame by means of which the base frame can be clamped onto the cutting frame and the base frame can be fixed to the ground. The cutting wheels are positioned on a vertically adjustable supporting unit, whereby the supporting unit having the cutting wheels can be pressed downward by means of vertically positioned hydraulic cylinders if the base frame is clamped firmly into the trench.

These well-known trench cutters have numerous different horizontally extendable clamping elements, since the major portion of the trench cutters is clamped against the walls of the trench. This also means that a significant proportion of the weight of the trench cutter is borne by the lateral walls of the trench. With the trench cutter's weight being laterally displaced in this way, thus it is no longer available as a pressing force for the cutting wheels. The pressing means having the hydraulic cylinders must be configured appropriately big so that these can compensate the lack of a pressing force of the weight of the trench wall apparatus on the one hand and can apply an additional pressing force on the cutting wheels on the other hand.

SUMMARY

The object of the invention is to provide a trench wall apparatus and a method for creating a trench in the ground, whereby with a simple construction of the trench wall apparatus can apply a high pressing force on a soil excavation means in a particularly efficient way.

The trench wall apparatus according to the invention is characterized in that the clamping means having at least two clamping elements and the at least one clamping cylinder are positioned on an intermediate frame which clamping means is mounted along the base frame such that it can slide, and that the pressing means is arranged between the intermediate frame and the base frame.

Furthermore, the method for creating a trench in the ground according to the invention is characterized in that the clamping means having the at least two clamping elements and the at least one clamping cylinder are positioned on an intermediate frame which clamping means is mounted along the base frame such that it can slide, that by the clamping means the intermediate frame is clamped and fixed to the ground, and that the base frame with the soil excavation means is pushed downward by means of the pressing means.

A basic idea behind the invention lies in the fact that, when working with harder soil material, a large portion of the weight of the trench wall apparatus still acts on the soil excavation means, whereby an additional pressing force is primarily applied by the pressing means.

According to the invention, this is achieved in that the base frame on which the trench wall apparatus is hung or held farther remains connected to the soil excavation means, while only a relatively small intermediate frame, on which the plate-like clamping elements and the at least one clamping cylinder are positioned, is being clamped against the surrounding walls of the trench. In this version, the base frame having the soil excavation means is mounted on the intermediate frame such that it can slide.

In this way a majority of the weight of the slurry wall apparatus is still able to act on the soil excavation means, even if the slurry wall apparatus is clamped in the trench. In this variation, the pressing means is positioned between the intermediate frame and the base frame such that through this a pressing force can be applied in addition to the weight of the base frame and the soil excavation means. Since the pressing means therefore only has an additional pressing force to apply, this pressing means can be made more compact and more cheaply overall.

One preferential embodiment of the slurry wall apparatus according to the invention consists of mounting the intermediate frame on an external side of the base frame such that it can slide. Suitable guiding and sliding means can be fitted on the external side of the base frame for the intermediate frame.

According to a refinement of the invention, it is particularly preferable for the base frame to have a box-like mounting section along which the intermediate frame is mounted and slidably guided. Here the mounting section on the base frame can have a smaller cross-section than adjoining areas of the base frame. In particular, the mounting section is designed such that the intermediate frame is mounted between an upper position and a lower position along the vertical or longitudinal axis of the base frame such that it can slide. There is formed preferably also a free space at the mounting section in which the clamping means having the clamping elements and the actuating cylinder are positioned such that these in their outer dimensions do not project beyond the outer circumference of the base frame when in a retracted position. When the clamping means is correspondingly actuated, the clamping elements are extended laterally, whereby these are moved from the retracted position into an outwardly protruding clamping position.

According to one variation of the invention, a particularly compact arrangement is achieved in that the intermediate frame has a clamp-like base carriage onto which the clamping elements are mounted such that they can slide. The base carriage of the intermediate frame is therefore a casing-like component that encloses the box-like mounting section in particular like a clamp. The plate-like clamping elements in particular, which have a relatively large surface area and correspond in their width largely to a width as the broadside of the base frame, are positioned on an external side of the base carriage. The at least one actuating cylinder is positioned between the base carriage and the clamping elements which actuating cylinder is preferably a hydraulically operated actuating cylinder, a so-called hydraulic cylinder.

In principle, only a single clamping element and a pair of clamping elements in particular can be provided, which can be moved between the retracted resting position and the extended clamping position by means of a single actuating cylinder. According to a further embodiment of the invention, it is particularly advantageous for multiple actuating cylinders to be positioned between the clamping elements and the base carriage. For plate-like clamping elements with a large surface area in particular, two, three, four, or more actuating cylinders can be provided. With a relatively large number of actuating cylinders results in a smaller installation space of an individual actuating cylinder but wherein still large actuating forces are to achieve overall.

In principle, the actuating cylinder(s) can be positioned in an appropriate way wherein the actuating forces can be transferred into a desired horizontal actuation of the clamping elements via corresponding transfer mechanisms.

A preferential embodiment of the trench wall apparatus according to the invention consists in that several actuating cylinders are provided that are positioned horizontally. This allows the actuating forces of the actuating cylinders to be directly transferred onto the clamping elements in horizontal direction. In particular, more than two clamping elements, for example two or four pairs of clamping elements, can be provided that are each actuated by actuating cylinders. The horizontal actuating cylinders can be positioned between the clamping elements and the intermediate frame or can extend through the intermediate frame and rest against clamping elements on both sides.

A further improvement as regards the usability of the trench wall apparatus is achieved in that several second actuating cylinders are provided that are tilted toward the horizontal. This allows corresponding connecting or transfer mechanisms to be provided by which the obliquely directed actuating forces are transferred as desired into a horizontal actuation of the clamping elements. Additionally, via the obliquely positioned actuating cylinders can also be achieved an inclination of the plate-like clamping elements which, in certain cases, can be advantageous for lowering and raising the slurry wall apparatus into or out of the ground.

Furthermore, a high adaptability of the slurry wall apparatus is reached in that each clamping element is connected via at least one pivoted lever to the base carriage such that it can be adjusted. This also allows relatively large transfer forces to be generated, if an installation space is limited.

In principle, the pressing means can be designed in any way that is suited for an additional pressing force to be applied onto the soil excavation means. The pressing means is positioned between the base frame and the soil excavation means.

According to a further embodiment of the invention, it is particularly advantageous for the pressing means to have at least one pressing cylinder, preferably several pressing cylinders. The pressing cylinders are preferably hydraulically operated. There can be provided two, three, or four hydraulic pressing cylinders in particular.

According to one variation of the invention, it is preferable for each pressing cylinder to be attached to the base frame on the one hand and on the other hand to the base carriage or a clamping element. At the base frame can be provided a corresponding holder onto which the individual pressing cylinders are flexibly attached. The cylinder housing is preferably attached to the base frame, while the free end of the cylinder piston is fitted to the base carriage or one of the clamping elements. The fitting also can be carried out by a tilting joint. The pressing means having the pressing cylinders can be positioned above or below the intermediate frame.

According to one embodiment of the invention, it is particularly expedient for the pressing cylinders to be tilted toward the vertical, whereby by actuation of the pressing cylinders the main base having the soil excavation means can be pressed downward relative to the clamped intermediate frame. The tilt of the pressing cylinders toward the vertical is preferably 1° to 30°, whereby the pressing cylinders are tilted outward in the direction of the intermediate frame. As a result of this tilt, a certain force component always is also generated in a horizontal direction when the pressing force is applied, causing the plate-shaped clamping elements to be pressed additionally against the surrounding wall of the trench. Through this is achieved a further good fixing of the position of the base frame in the trench also when large pressing forces are applied to the soil excavation means.

It is also advantageous for the slurry wall apparatus to be designed like a trench cutter, whereby the soil excavation means has at least one cutting wheel. There are preferably several cutting wheels, in particular two pairs of cutting wheels, i.e. a total of four cutting wheels. The trench cutter designed in this way can excavate soil continuously, whereby, depending on the embodiment, the excavated soil material is discharged outside of the cut trench via suitable pumping means or is mixed in situ with slurry supplied within the cut trench.

According to a further embodiment of the invention, alternative it is provided for the trench wall apparatus to be designed as a trench wall grab, whereby the soil excavation means has a grabbing bucket 23, as shown in FIG. 7. A slurry wall grab can be used to excavate soil discontinuously. The design according to the invention allows particularly large pressing forces to be generated, by means of which the grabbing bucket 23 can penetrate into the soil to be excavated particularly effectively.

The invention will be described further hereinafter by way of preferential exemplary embodiments, which are schematically depicted in the drawings. Shown in the drawings are:

DETAILED DESCRIPTION

Figure 1:
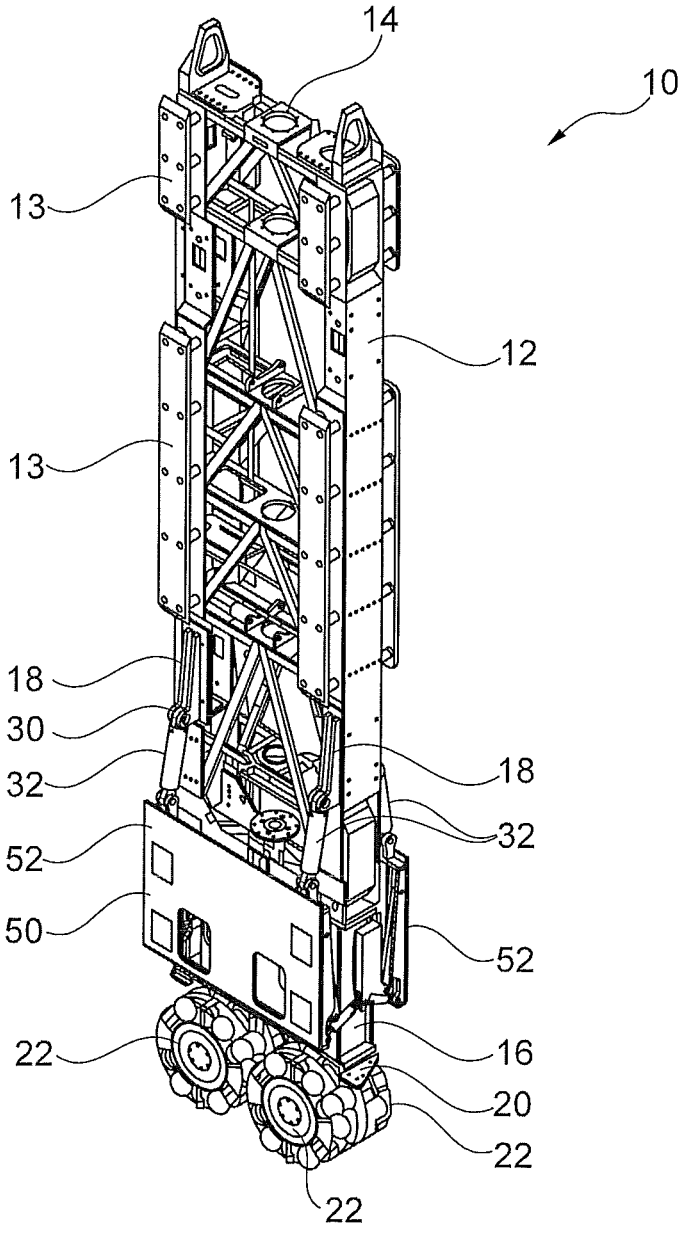
FIG. 1 a perspective view of a scaled-down trench wall apparatus according to the invention.

A trench wall apparatus 10 according to the invention according to FIG. 1 is constructed as a trench cutter with a base frame 12 at the bottom end of which two pairs of cutting wheels 22 are attached as a soil excavation means 20. The trench wall apparatus 10 is attached to a mast of a carrier vehicle (not shown) at the top end of the base frame 12 via a holding means 14 that is not shown in more detail, in particular by means of a carrying rope.

The base frame 12 is provided with protruding, plate-shaped guiding elements 13 along its external side, which serve to guide the trench cutter inside the cut trench. In an intermediate area of the base frame 12, in particular in the lower half and near to the soil excavation means 20 on a mounting section 16 is designed a clamping means 50 with two plate-shaped clamping elements 52 on opposite side. The plate-shaped clamping elements 52 essentially extend along the entire longitudinal side or broadside of the trench wall apparatus 10, achieving a support with a large surface area along the wall of the trench being cut. Through the corresponding rotation of the cutting wheels 22, the trench is excavated via hydraulic drives on the base frame 12 that are not shown in more detail. The excavated soil material is pumped away together with a stabilizing suspension, which is supplied to the trench being built itself, via a pumping means (not shown) on the base frame 12 and transported away towards above ground.

During a normal operation, the maximum pressing force of the slurry wall apparatus 10 onto the soil excavation means 20 is given and limited by the weight of the trench wall apparatus 10. A pressing means 30 with pressing cylinders 32 is provided in order to increase a pressing force on the soil excavation means 20, for instance when impacting on harder stony material.

The design and operation made of the clamping means 50 and the pressing means 30 shall be described in greater detail below in connection with the FIGS. 2 to 6.

The clamping means 50 with the two plate-shaped clamping elements 52 is mounted on an intermediate frame 60 with a case-shaped base carriage 62. The base carriage 62 with its rectangular open cross-section is axially mounted onto the box-shaped mounting section 16 of the base frame 12 along a longitudinal axis of the base frame 12. The case-shaped base carriage 62 thus fittingly encloses the rectangular mounting section 16 as shown particularly clearly in the FIGS. 3 and 5.

Figure 3:
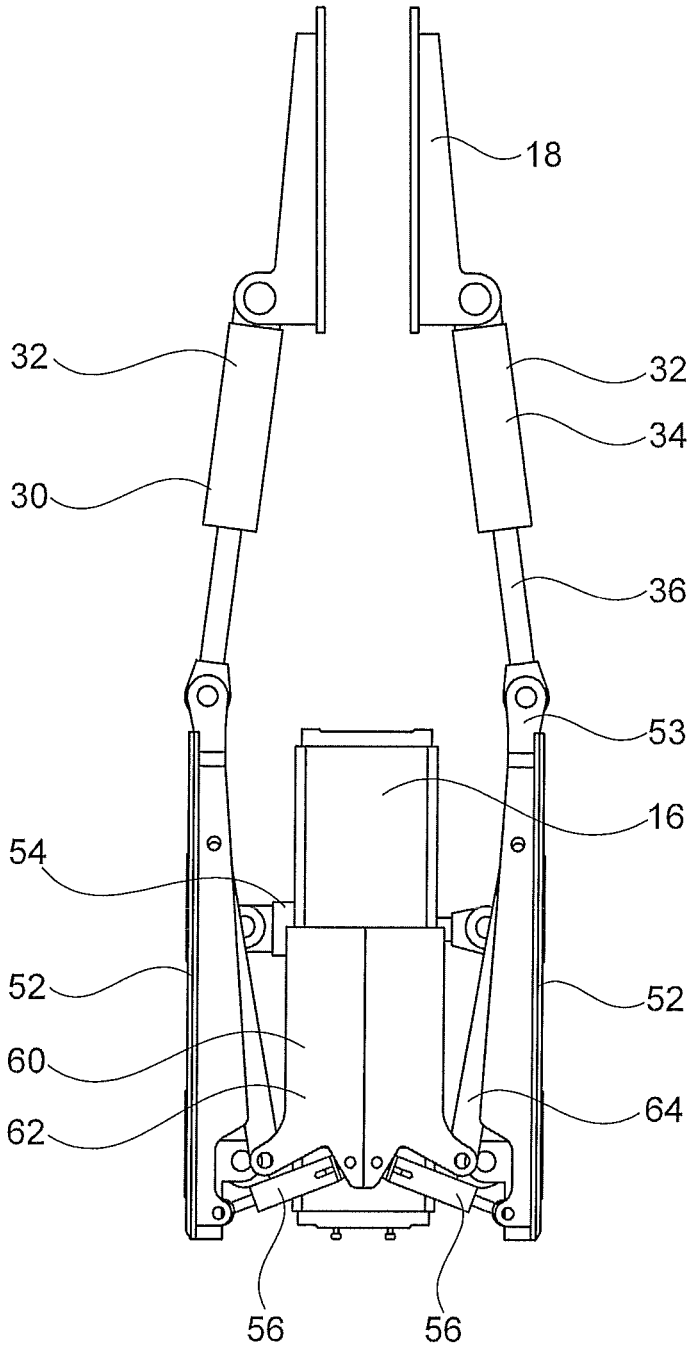
FIG. 3 a side view of the clamping means of FIG. 2 in a clamping state.
Figure 4:
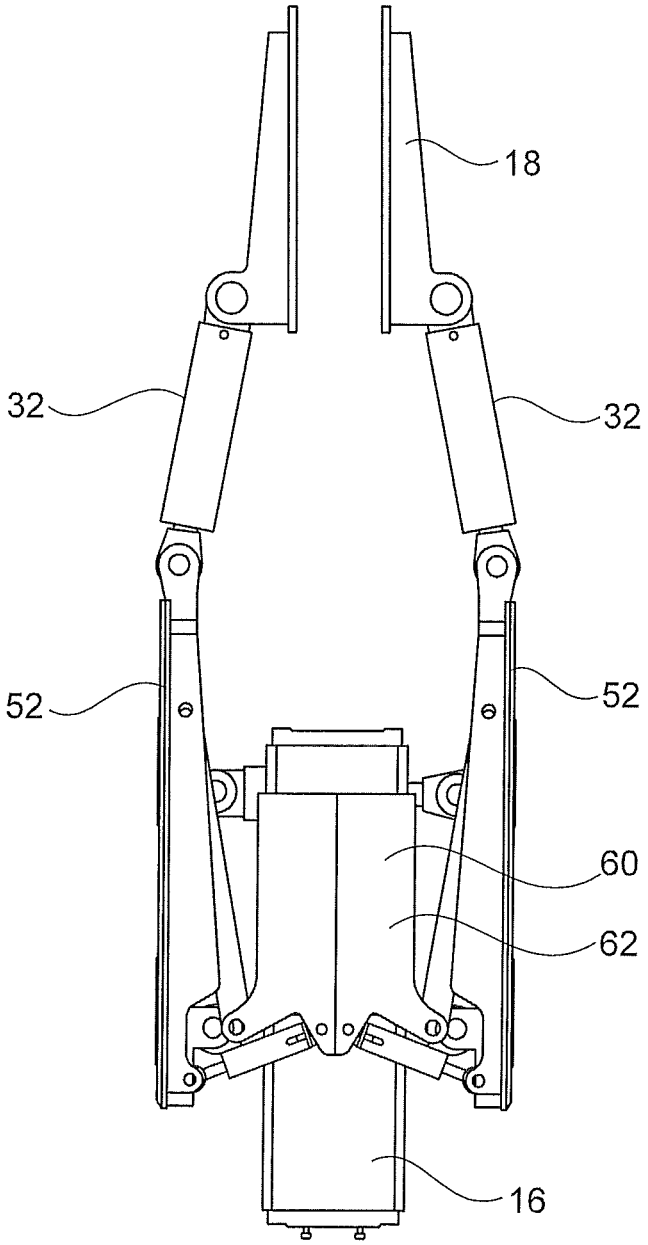
FIG. 4 a side view of the clamping means of FIG. 3 in a clamping state and during generating a downward pressing force.
Figure 5:
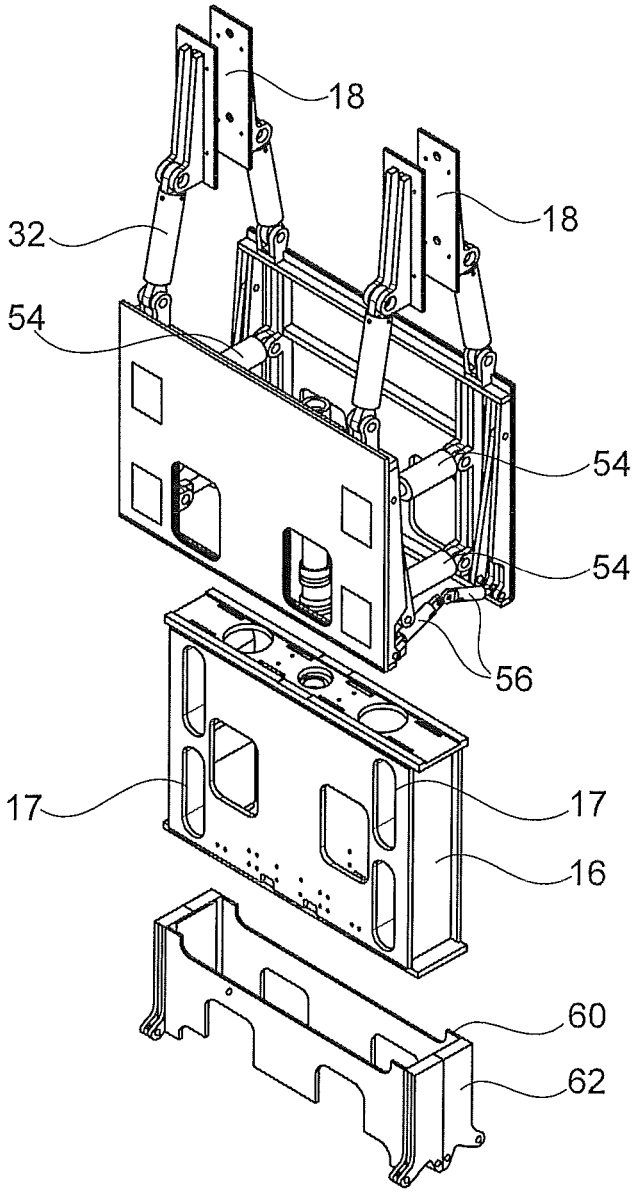
FIG. 5 an exploded view of the clamping means of the FIGS. 2 to 4.
Figure 6:
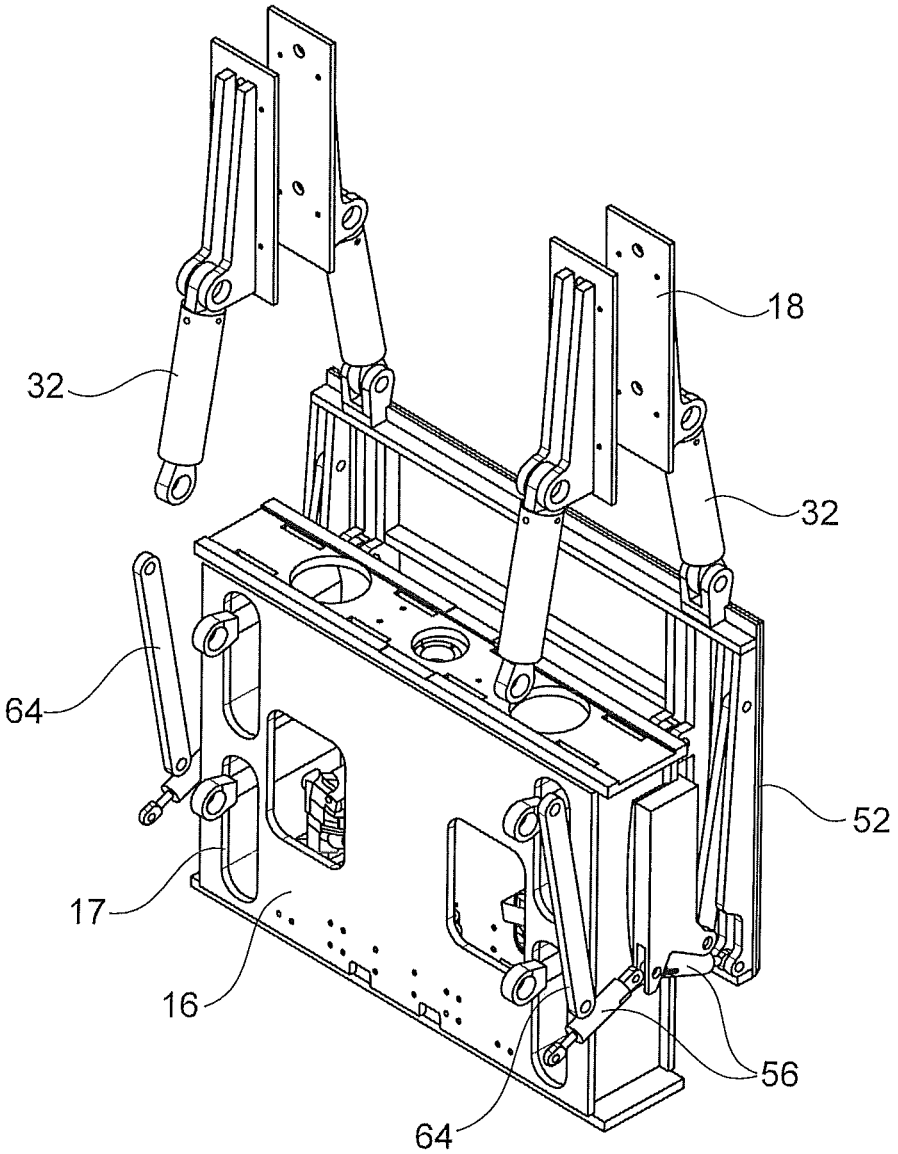
FIG. 6 another perspective view of the clamping means of the FIGS. 2 to 5, in a partly dismantled state.
Figure 7:
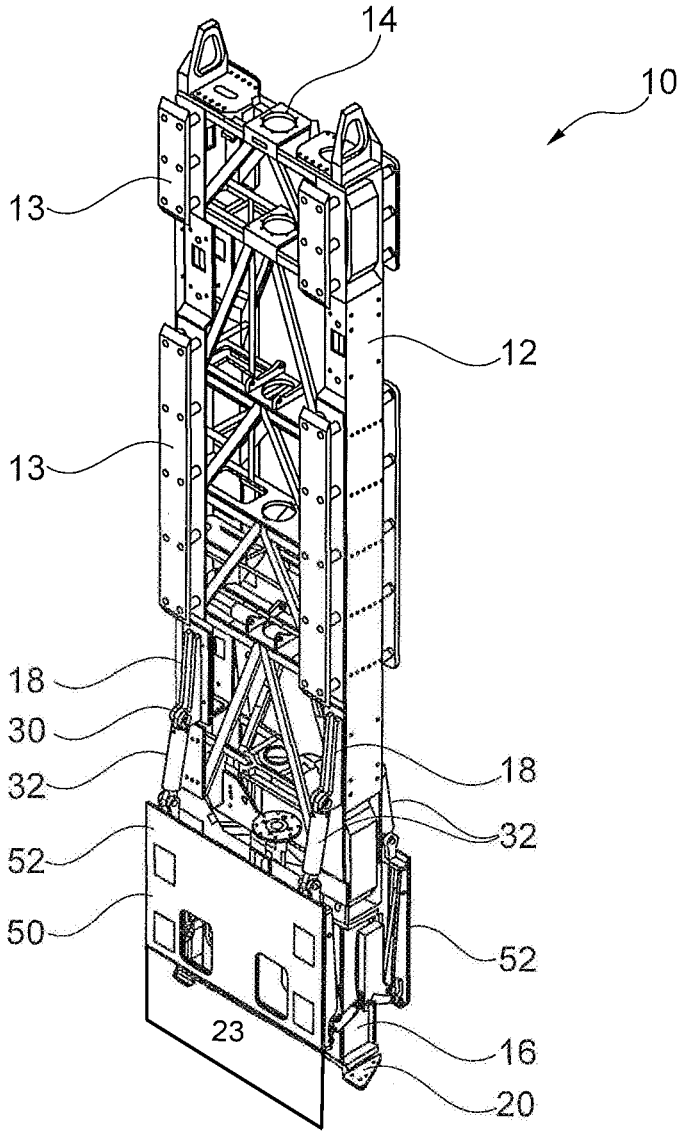
FIG. 7 a perspective view of a modification of the scaled-down trench wall apparatus shown in FIG. 1.

In order to essentially move the plate-shaped clamping elements 52 horizontally between a retracted resting position and a clamping position shown in the FIGS. 3 and 4, the clamping means 50 has several, preferably four, first actuating cylinders 54. These essentially extend horizontally through recesses in the base carriage 62 and the mounting section 16 between the two clamping elements 52, to which they are flexibly attached. In this way, each of the clamping elements 52 positioned in parallel and opposite serves as an abutment for the other clamping element 52. Preferably, the first horizontal actuating cylinders 54 do not touch the base carriage 62 nor the mounting section 16. The recesses 17 in the mounting section 16 are designed as vertical directed long holes to allow the first actuating cylinders 54 that protrude through them to move vertically.

The clamping elements 52 are each flexibly attached to the base carriage 62 via two pivoted levers 64 positioned parallel to each other. Furthermore, there are respectively arranged two second actuating cylinders 56 for each clamping element 52, which are positioned in a tilted position toward the horizontal. The second actuating cylinders 56 are each articulated to one eye of the clamping element 52 and one eye of the base carriage 62. By actuating the second actuating cylinder 56 an alignment of the plate-shaped clamping elements 52 can be adjusted in deviation to the vertical.

In order to generate a pressing force on the soil excavation means 20, the invention has a pressing means 30 with two hydraulic cylinders 32 per clamping element 52 is provided above the clamping means 30. The pressing cylinders 32 extend from one eye 53 on the top end of the clamping elements 52 as far as a holder 18, which are firmly attached to the base frame 12 of the trench wall apparatus 10.

In the embodiment shown, the cylinder housings 34 of the pressing cylinders 32 are attached to the holder 18, while the respective pistons 36 extend to the clamping elements 52.

Figure 2:
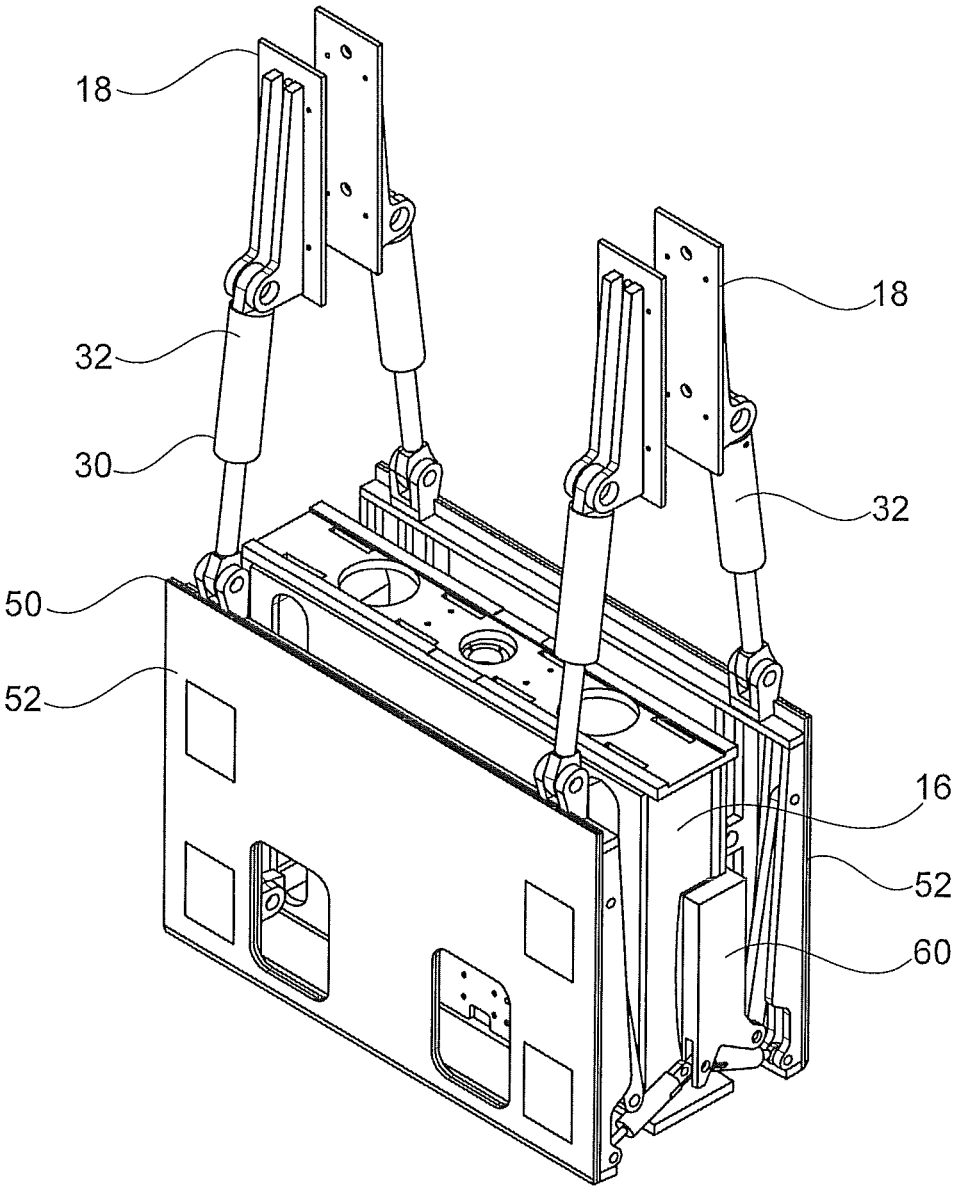
FIG. 2 a perspective detail view of a clamping means of the trench wall apparatus of FIG. 1.

In the FIGS. 2 and 3, the clamping means 50 is shown in a clamping state, whereby no additional pressing force is applied to the soil excavation means 20 by the pressing means 30.

Through retracting of the pressing cylinders 32, whereby the pistons 36 are retracted into the cylinder housings 34, the holders 18 and the base frame 12 firmly connected to them are pressed axially downward in regard to the outwardly extended clamping elements 52, which are clamped and thus firmly fixed to the wall of the trench. At the same time, the base frame 12 with its mounting section 16 slides downward relative to the base carriage 62 of the intermediate frame 60, as shown clearly in FIG. 4. This means that, through retracting of the pressing cylinders 32, a pressing force can be applied to the base frame 12 and to the soil excavation means 20 attached to the underside of the base frame 12. At the same time, the base frame 12 can be moved downward in regard to the clamped clamping means 50 and the base carriage 62. In the arrangement according to the invention, the pressing force applied by the pressing cylinders 32 thus adds with the weight of the base frame 12, which remains resting on the soil excavation means 20. According to the invention, a relatively high pressing force can thus be applied to the soil excavation means 20 overall, in particular to the cutting wheels 22.

The recesses 17 in the mounting section 16 are in the form of vertically directed long holes to allow the clamping means 50 to be displaced relative to the base carriage 12 with the mounting section 16. By a corresponding extending of the pressing cylinders 32 back into the position according to FIG. 3, this conversely causes the base frame 12 to lift and slide again in regard to the base carriage 62 of the intermediate frame 60, so that the soil excavation means 20 is then unburdened correspondingly.

The invention claimed is:

1. A trench wall apparatus for creating a trench in the ground, the trench wall apparatus comprising:

a base frame;

at least one soil excavation means, which is positioned at a bottom section of the base frame;

a holding means configured to vertically suspend the trench wall apparatus at a top section of the base frame;

a clamping means with at least two planar clamping elements disposed on opposite sides of the trench wall apparatus and laterally displaceable, and at least one actuating cylinder, through which the clamping elements are configured to extend laterally against a wall of the trench in order to clamp at least one part of the trench wall apparatus in the trench; and a pressing means configured to apply a pressing force to the at least one soil excavation means, wherein the clamping means with the at least two planar clamping elements and the at least one actuating cylinder are positioned on an intermediate frame, which is mounted along the base frame to a mounting section such that the intermediate frame is displaceable;

the pressing means is positioned between the intermediate frame and the base frame and has a plurality of pressing cylinders;

the pressing cylinders are arranged in a tilted way toward a vertical plane, whereby the base frame with the soil excavation means is configured for being pressed downward relative to the intermediate frame when actuating the pressing cylinders; and each tilted pressing cylinder is articulated to the base frame on one end and is directly connected to one of the planar clamping elements on an other end.

2. The trench wall apparatus according to claim 1, wherein the intermediate frame is mounted on an external side of the base frame.

3. The trench wall apparatus according to claim 1, wherein the intermediate frame has a base carriage, on which the clamping elements are mounted for being displaced.

4. The trench wall apparatus according to claim 3, wherein the at least one actuating cylinder is a plurality of actuating cylinders that are positioned between the clamping elements and the base carriage.

5. The trench wall apparatus according to claim 1, wherein the at least one actuating cylinder includes first actuating cylinders that are positioned horizontally.

6. The trench wall apparatus according to claim 1, wherein the at least one actuating cylinder includes second actuating cylinders that are tilted toward a horizontal direction.

7. The trench wall apparatus according to claim 1, wherein each clamping element is connected in a displaceable way to a base carriage by at least one pivoted lever.

8. The trench wall apparatus according to claim 1, wherein the at least one soil excavation means has at least one cutting wheel configured as a trench cutter.

9. The trench wall apparatus according to claim 1, wherein the at least one soil excavation means has a grabbing bucket.

10. A method for creating a trench in the ground, the method comprising:

providing a trench wall apparatus according to claim 1;

holding the top section of the base frame of the trench wall apparatus by the holding means;

excavating soil by means of the at least one soil excavation means while forming the trench;

clamping at least the intermediate frame in the trench by extending the at least two clamping elements against a wall of the trench by the at least one actuating cylinder; and applying a pressing force to the at least one soil excavation means by the pressing means.

* * * * *